US008662139B2

(12) United States Patent
Anthony et al.

(10) Patent No.: US 8,662,139 B2
(45) Date of Patent: Mar. 4, 2014

(54) METHODS AND APPARATUS TO PROVIDE UPPER AND LOWER TRAVEL LIMITS FOR COVERING OF AN ARCHITECTURAL OPENING

(75) Inventors: James M. Anthony, Denver, CO (US); Stephen P. Smith, Denver, CO (US); Daniel Fluckey, Denver, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 491 days.

(21) Appl. No.: 12/816,152

(22) Filed: Jun. 15, 2010

(65) Prior Publication Data

US 2011/0139380 A1 Jun. 16, 2011

Related U.S. Application Data

(60) Provisional application No. 61/187,271, filed on Jun. 15, 2009.

(51) Int. Cl.
*E06B 9/40* (2006.01)

(52) U.S. Cl.
USPC ..... 160/293.1; 160/121.1

(58) Field of Classification Search
USPC ..... 160/293.1, 294, 295, 84.01, 84.04, 160/84.05, 121.1, 170, 171; 200/47
See application file for complete search history.

(56) References Cited

U.S. PATENT DOCUMENTS

| | | | | | |
|---|---|---|---|---|---|
| 1,678,790 | A * | 7/1928 | Salesse | 160/295 |
| 1,725,285 | A * | 8/1929 | Lalonde | 160/295 |
| 1,786,512 | A * | 12/1930 | Whitworth | 160/295 |
| 2,020,595 | A * | 11/1935 | Weber | 160/295 |
| 2,276,740 | A * | 3/1942 | Saito | 200/47 |
| 2,678,094 | A * | 5/1954 | Sargent | 160/295 |
| 2,951,920 | A * | 9/1960 | Miller | 200/47 |
| 3,825,809 | A * | 7/1974 | Gatland et al. | 318/282 |
| 3,965,960 | A * | 6/1976 | Massey | 160/295 |
| 4,247,744 | A * | 1/1981 | Birkle | 200/47 |
| 5,044,417 | A * | 9/1991 | Bresson | 160/310 |
| 5,299,678 | A * | 4/1994 | Chang et al. | 192/141 |
| 5,711,360 | A * | 1/1998 | Viotte | 160/310 |
| 5,924,949 | A * | 7/1999 | Fan | 475/149 |
| 7,161,100 | B1 * | 1/2007 | Hsieh | 200/47 |
| 7,234,503 | B2 * | 6/2007 | Kwak | 160/296 |
| 7,240,715 | B2 | 7/2007 | Hoffmann | |
| 7,513,292 | B2 | 4/2009 | Auger et al. | |
| 7,857,033 | B2 * | 12/2010 | Malausa | 160/310 |
| 2005/0150608 | A1 * | 7/2005 | Auger et al. | 160/84.05 |
| 2008/0223532 | A1 * | 9/2008 | Auger | 160/292 |

* cited by examiner

*Primary Examiner* — David Purol
(74) *Attorney, Agent, or Firm* — Hanley, Flight and Zimmerman, LLC

(57) ABSTRACT

Methods and apparatus to provide upper and lower travel limits for architectural opening coverings are disclosed. A disclosed architectural opening covering assembly includes a rotatable roller tube and a covering mounted to the roller tube. The covering is movable between a lowered position and a raised position. The covering is wound on the roller tube in the raised position. The covering assembly further includes a first limit nut located internal to the roller tube to define the lowered position, and a second limit nut located internal to the roller tube to define the raised position.

22 Claims, 16 Drawing Sheets

METHODS AND APPARATUS TO PROVIDE UPPER AND LOWER TRAVEL LIMITS FOR COVERING OF AN ARCHITECTURAL OPENING

RELATED APPLICATION

This patent claims the benefit of U.S. Provisional Patent Application Ser. No. 61/187,271, filed on Jun. 15, 2009, which is hereby incorporated herein in its entirety.

FIELD OF THE DISCLOSURE

This disclosure relates generally to architectural opening covering assemblies, and, more particularly, to methods and apparatus to provide upper and lower travel limits for architectural opening covering assemblies.

DISCUSSION OF THE RELATED ART

Architectural opening covering assemblies (e.g., blinds, shades, shutters, etc) of different types are known. In some such covering assemblies, a flexible material such as fabric is mounted on a rotatable rail. A drive mechanism is operatively coupled to the rail to enable a user to raise and lower the covering by rolling the covering onto or off of the rotatable rail.

BRIEF DESCRIPTION OF THE DRAWINGS

Wherever possible, the same reference numbers will be used throughout the drawing(s) and accompanying written description to refer to the same or like parts.

DETAILED DESCRIPTION

Figure 1:
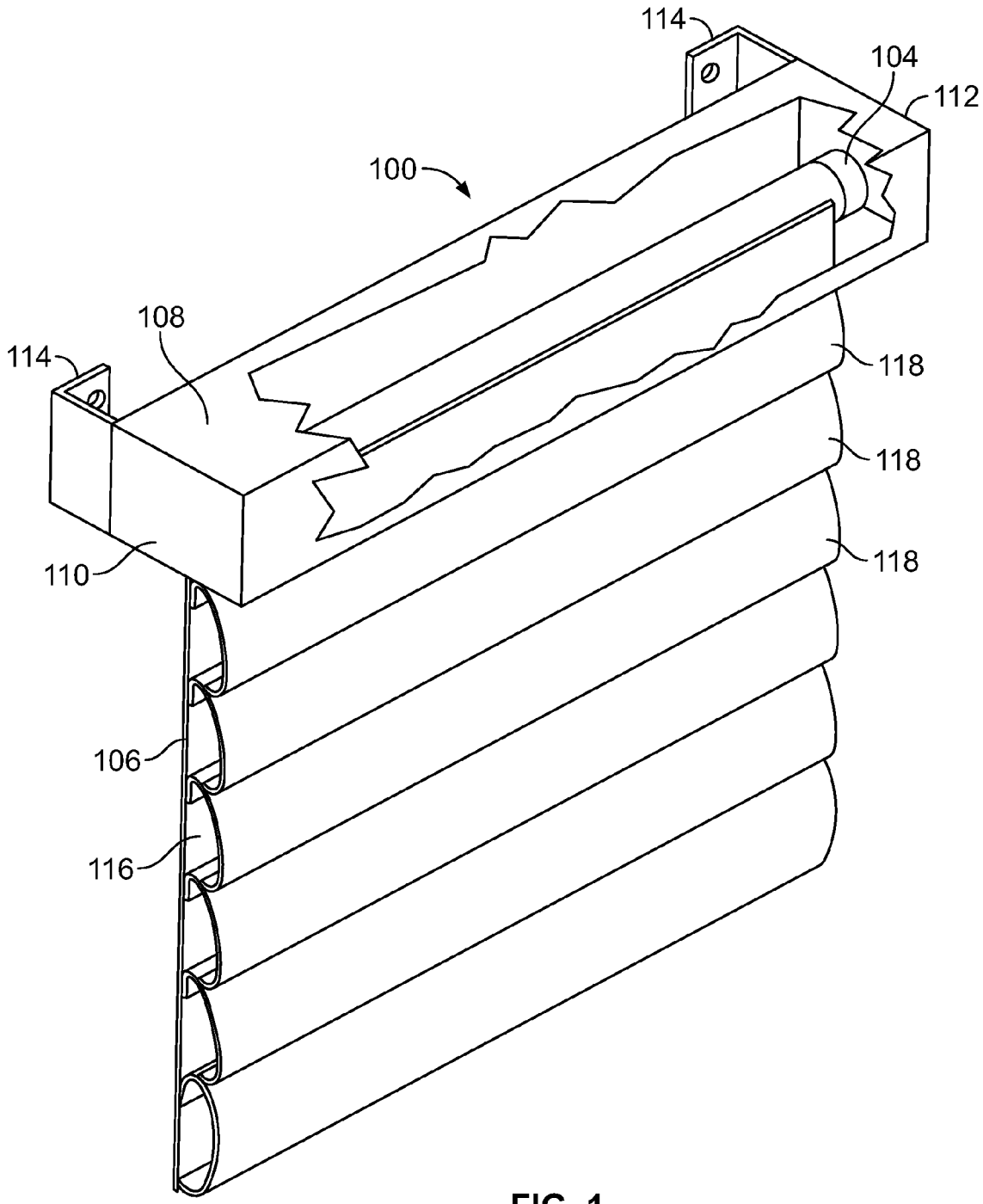
FIG. 1 illustrates an example architectural opening covering assembly.

Some known architectural opening covering assemblies include a flexible covering such as fabric mounted on a rotatable rail. A drive mechanism is operatively coupled to the rail to enable a user to raise and lower the flexible covering by rolling the covering onto or off of the rotatable rail. To avoid fouling of the covering and/or the drive mechanism for raising and lowering the same (e.g., cords or loops), some known covering assemblies have included positive stops located at the lower corners of the flexible covering. These stops are positioned to engage respective stops on the headrail or end caps in which the rotatable rail is mounted to provide a physical limit to the raised position of the covering and to prevent the covering from being over wound on to the rail. Additionally, some coverings have included a single stop in the headrail and/or within the rotatable rail itself to provide a limit on the lowered position of the covering. The positive stops on the lower corners of the flexible material are effective, but some consumers do not like their appearance. Also, over time, the flexible coverings may exhibit some degree of skew. Such skew can cause one or both of the positive stops on the lower corners of the covering to experience reduced effectiveness.

An example architectural opening covering assembly disclosed herein includes a rotatable roller tube and a covering mounted to the roller tube. The covering is movable between a lowered position and a raised position. The covering is wound on the roller tube in the raised position. The example architectural opening covering also includes a first limit nut located internal to the roller tube to define the lowered position, and a second limit nut located internal to the roller tube to define the raised position. No external positive stops are required on the covering to provide upper or lower travel limits on the covering. Instead, the limit nuts within the roller tube provide raised and lowered travel limits on the covering.

Another example architectural opening covering assembly includes a rotatable roller tube and a covering mounted to the roller tube. The covering is movable between a lowered position and a raised position, and is wound on the roller tube to reach the raised position. The architectural opening covering assembly also includes a drive mechanism to move the covering between the raised and lowered positions and a dual travel limit assembly. The dual travel limit assembly includes a first threaded member and a second threaded member. The dual travel limit assembly also includes a first limit nut threadably engaging the second threaded member and cooperating with a first fixed stop to define the lowered position, and a second limit nut threadably engaging the first threaded member and cooperating with a second fixed stop to define the raised position.

In some examples, the second threaded member is selectively rotatable relative to the first threaded member. In some such examples, the architectural opening covering assembly includes a toothed thumb wheel associated with the second threaded member, and a latch to selectively lock the second threaded member against rotating relative to the first threaded member and an endcap. In such examples, the latch is releasable to permit adjustment of the lower limit nut (e.g., to permit rotation of the thumb wheel and the second threaded member relative to the first threaded member). Such adjustment of the lower limit nut may be performed, for example, at an installation site by an installer or end user to adapt the lowered position of the covering to meet the dimensions of the window, thereby ensuring the window is fully covered when the covering is in the lowered position.

Example methods of reducing or eliminating an uncaptured loop in a raised covering of an architectural opening covering assembly are also disclosed. Such methods may be performed in a factory or at the installation site by an installer or an end user. These example methods include releasing a latch to permit adjustment of a rotatable top stop (e.g., a limit nut) within a rotatable roller tube; lowering the covering; rotating the top stop until it engages a fixed stop within the roller tube; raising the covering to the raised position wherein the covering does not exhibit an uncaptured loop; and thereafter securing the latch.

Example methods of assembling a dual travel limit stop for an architectural opening covering assembly include sliding a bearing onto a second threaded member, threading a first limit nut onto the second threaded member, and threading a second limit nut onto a first threaded member. The first limit nut is positioned to cooperate with a first fixed stop to define a lower travel limit for a covering of the covering assembly. The second limit nut is positioned to cooperate with a second fixed stop to define a top travel limit for the covering. The example methods also include fastening the second threaded member to an end cap.

In some example methods, the second threaded member is penetrated with the first threaded member prior to fastening the first threaded member to the end cap. In some of these methods, the threads of the second threaded member and the threads of the first threaded member have substantially circular cross sections of substantially the same diameter. In some examples, a central axis of the second threaded member is substantially co-axial with a central axis of the first threaded member. In some examples, the second threaded member is tubular and the first threaded member is tubular.

Example methods of assembling an architectural opening covering assembly include mounting a covering to a rotatable roller tube; sliding a bearing onto a second threaded member; threading a first limit nut onto the second member; and threading a second limit nut onto a first threaded member. These methods also include fastening the first threaded member to an end cap; rotating the first and second limit nuts into respective engagement with first and second fixed stops; sliding the first and second limit nuts into engagement with a key within the roller tube; coupling the end cap to a headrail; releasing a latch to permit rotation of the second threaded member carrying the first limit nut; lowering the covering to a lowered position; and securing the latch to define a bottom travel limit for the covering.

Figure 2:
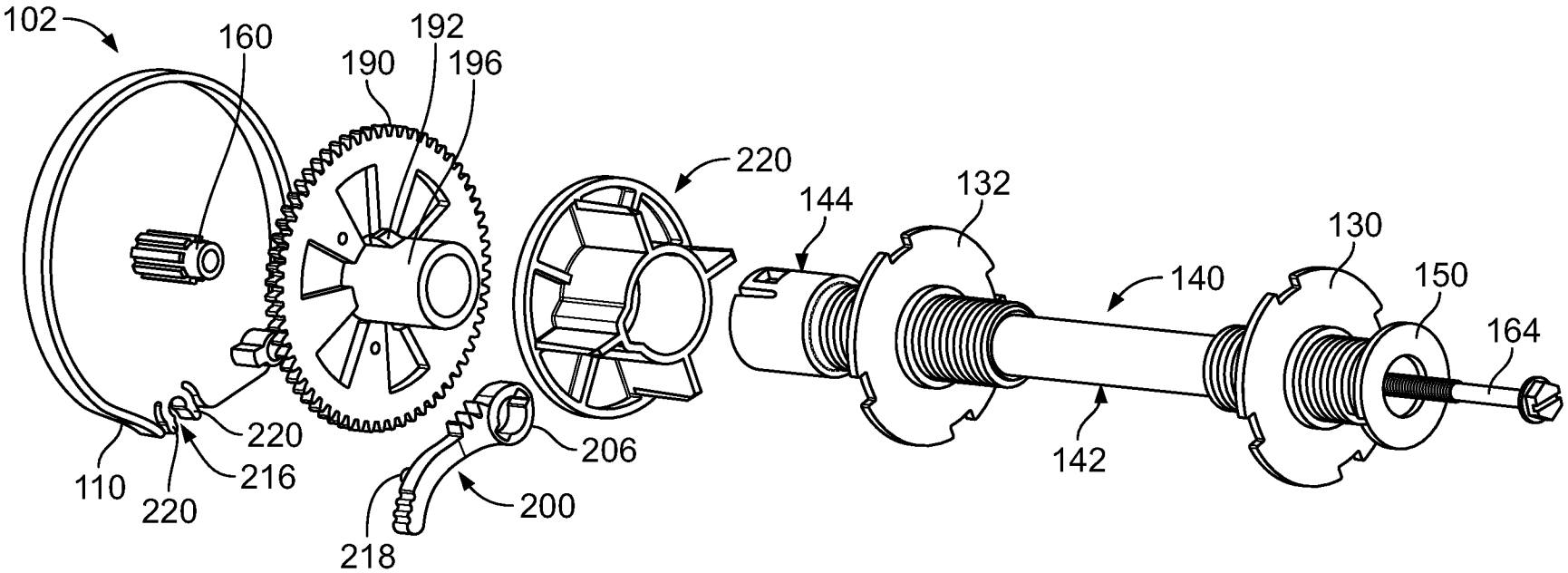
FIG. 2 is an exploded perspective view of an example dual travel limit assembly employed within the rotatable roller tube of the example covering assembly of FIG. 1.

Turning more specifically to the illustrated examples, FIG. 1 is an isometric illustration of an example architectural opening covering assembly 100 that includes the example dual travel limit assembly 102 of FIG. 2. The dual travel limit assembly 102 of FIG. 2 is located within the rotatable roller tube 104 of the example opening covering assembly 100 and provides a limit on the raised position of the covering 106 of the covering assembly 100, as well as a limit on the lowered position of the covering 106. In other words, the dual travel limit assembly 102 defines the fully raised and fully lowered positions of the covering 106. The dual travel limit assembly 102 sets these limits without requiring the inclusion of positive stops on the covering itself. Because the dual travel limit assembly 102 is located within the roller tube 104, the stops providing the raised and lowered travel limits are not visible to the end user. In addition, as explained in further detail below, in a first implementation, the dual travel limit assembly enables subsequent re-setting of a lower limit position for purposes of ensuring the covering fully covers a window opening (e.g., reaches a windowsill). In a second implementation, the dual travel limit assembly enables subsequent re-setting of an upper limit position for purposes of reduction and/or elimination of an uncaptured loop from the covering 106, thereby improving the visual appearance of the opening covering assembly 100 when the covering 106 is in the raised position.

In the example of FIG. 1, the covering assembly 100 includes a headrail 108. The headrail 108 is a housing having opposed end caps 110, 112 joined by front, back and top sides to form an open bottom enclosure. The headrail 108 also has mounts 114 for coupling the headrail 108 to a structure above an architectural opening such as a wall via mechanical fasteners such as screws, bolts, etc. The roller tube 104 is journalled between the end caps 110, 112. Although a particular example of a headrail 108 is shown in FIG. 1, many different types and styles of headrails exist and could be employed in place of the example headrail of FIG. 1. Indeed, if the aesthetic effect of the headrail 108 is not desired, it can be eliminated in favor of mounting brackets.

In the example illustrated in FIG. 1, the covering 106 is a cellular type of shade. In this example, the cellular covering 106 includes a unitary flexible fabric (referred to herein as a "backplane") 116 and a plurality of cell sheets 118 that are secured to the backplane 116 to form a series of cells. The cell sheets 118 may be secured to the backplane 116 using any desired fastening approach such as adhesive attachment, sonic welding, weaving, stitching, etc. The covering 106 shown in FIG. 1 can be replaced by any other type of covering including, for instance, single sheet shades and/or other cellular coverings. In the illustrated example, the covering 106 has an upper edge mounted to the roller tube 104 and a lower, free edge. The covering 106 is movable between a raised position and a lowered position (illustratively, the position shown in FIG. 1). When in the raised position, the covering 106 is wound about the roller tube 104. The lower free edge of the covering 106 does not include positive stops to limit upward movement of the covering 106, as such limits are provided by the dual travel limit assembly 102.

Although not shown in the Figures, the example architectural opening covering assembly 100 is provided with a drive mechanism to move the covering between the raised and lowered positions. The drive mechanism can take any form (e.g., a clutch, a gear, a motor, a drive train, and/or a gear train, etc.) and include any type of controls (e.g. continuous loop, raise/lower cord(s), chains, ropes, etc). In some examples, the drive mechanism is implemented as a single cord operating system. In other examples, a powered drive mechanism is employed. In such examples, the stops of the dual travel limit assembly 102 are particularly useful. For example, a motor control circuit will detect a spike in current when the stop reaches the end of its travel. When the current exceeds a limit, the motor is turned off.

Turning in detail to FIG. 2, the example dual travel limit assembly 102 includes a first limit nut 132 to define the lowered position of the covering 106 and a second limit nut 130 to define the raised position of the covering 106. Both the first and the second limit nuts 130, 132 are located internal to the roller tube 104. Preferably, the first and second limit nuts are identical in construction. Such an approach reduces manufacturing costs by reducing the number of different parts requiring fabrication, etc.

The example dual travel limit assembly 102 is provided with a spindle 140. In the illustrated example, the spindle 140 includes a first threaded member 142 and a second threaded member 144. As shown in FIG. 2, the second threaded member 144 and the first threaded member 142 nest to form the spindle 140. The second threaded member 144 is closer to the end cap than the first threaded member 142.

Figure 3:
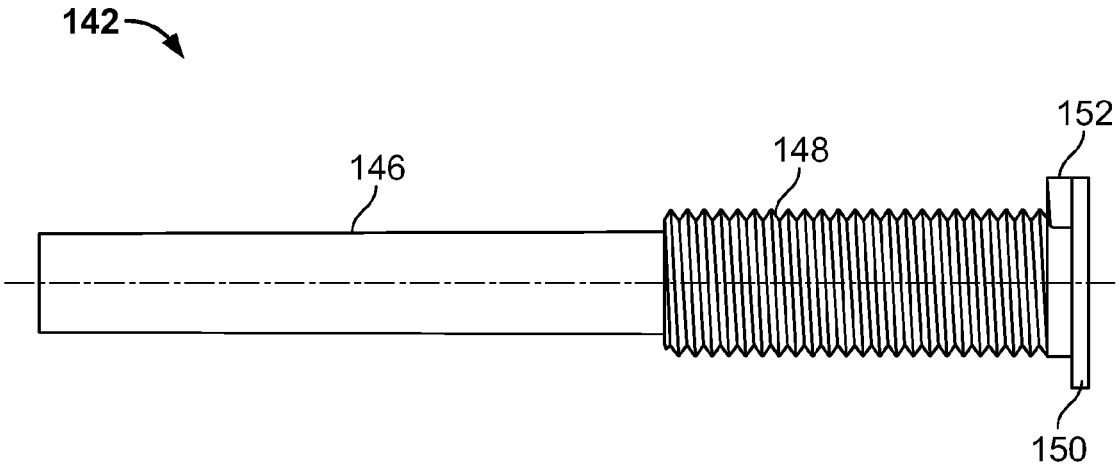
FIG. 3 is a side plan view of the example first threaded member of FIG. 2.
Figure 4:
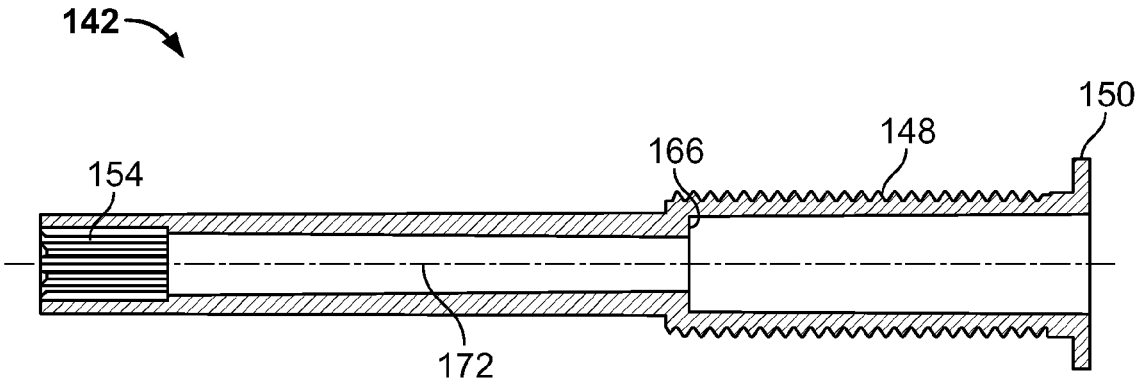
FIG. 4 is a cross-sectional view of the first threaded member of FIG. 3.

The example first threaded member 142 is shown in greater detail in FIGS. 3 and 4. In the illustrated example, the first threaded member 142 is a tubular member that includes an unthreaded, tubular seat 146 and a threaded portion 148. One end of the first threaded member 142 includes a flange 150. The flange 150 has a larger diameter than the threaded portion 148. A fixed stop 152 (see FIG. 3) extends from the flange 150. In the illustrated example, the first threaded member 142 is a unitary, plastic molded structure (i.e., the tubular seat 146, the threaded portion 148, the flange 150 and the fixed stop 152 are integrally formed). However, the first threaded member 142 may be constructed of multiple parts and/or formed of different materials, if desired.

As show in FIG. 4, the end of the first threaded member 142 opposite the flange 152 includes an inner ribbed surface 154. This inner ribbed surface 154 is dimensioned to mate with a splined lug 160 extending from the inner surface of an end cap 110 of the headrail 108 (see FIGS. 2, 5 and 6). Engagement of the splines of the lug 160 and the ribs of the inner ribbed surface 154 of the first threaded member 142 substantially secures the first threaded member 142 against rotation relative to the end cap 110. To facilitate securement of the first threaded member 142 to the end cap 110, the splined lug 160 includes an untapped central bore. A mechanical fastener such as a thread forming screw 164 (see FIG. 2) passes through the hollow interior of the tubular first threaded member 142 and threadingly engages the bore of the splined lug 160 to create threads in the untapped central bore. As shown in FIG. 4, the interior of the first threaded member 142 is stepped down and forms an inner shoulder 166. The length of the fastener 164 and the position of the shoulder 166 are selected to permit the fastener 164 to thread into the splined lug 160 and to hold the first threaded member 142 snugly to the end cap 110. The lug 160 of the illustrated example is integrally formed with the end cap 110. In particular, the end cap 110 and the spine 160 comprise a unitary, plastic molded structure. However, other approaches to forming the end cap (e.g., different materials, multiple parts, etc.) may be employed, if desired.

Figure 7:
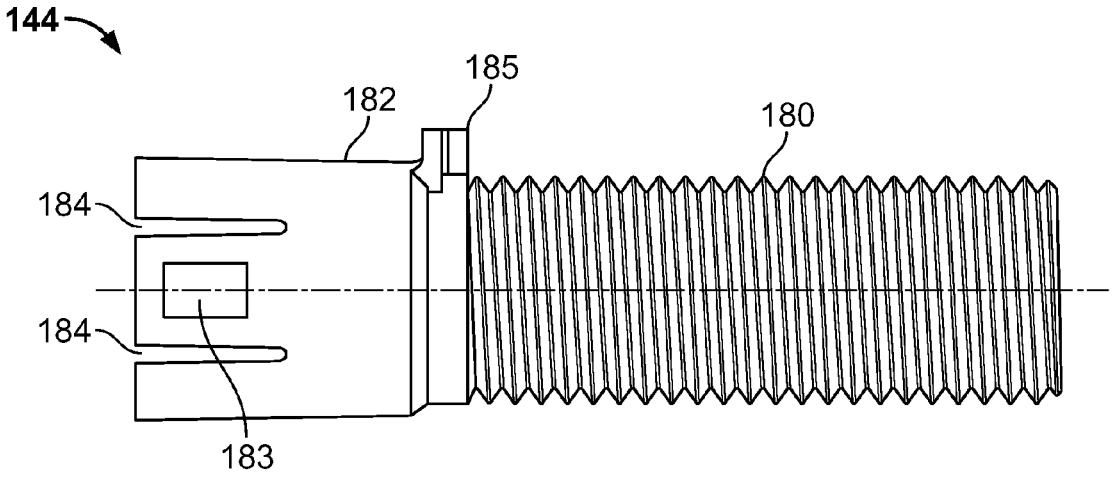
FIG. 7 is a side plan view of the example second threaded member of FIG. 2.
Figure 8:
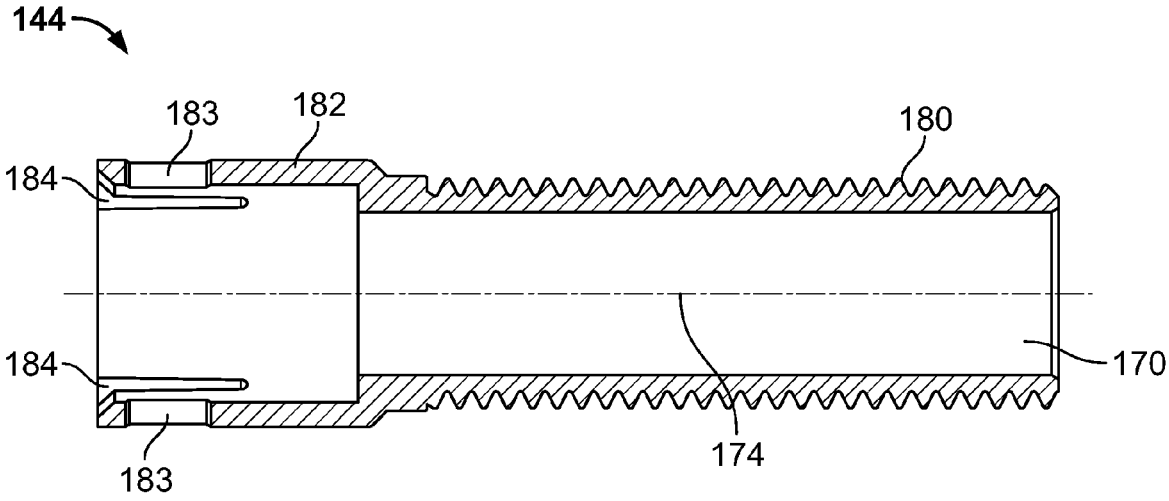
FIG. 8 is a cross-sectional view of the second threaded member of FIG. 7.

The example second threaded member 144 is shown in greater detail in FIGS. 7 and 8. In the illustrated example, the first threaded member 142 is adapted to penetrate the second threaded member 144. In particular, the second threaded member 144 is a tubular member defining an inner lumen having a diameter 170 that is slightly larger than the outer diameter of the tubular seat 146 of the first threaded member 144. As a result, the second threaded member 144 is adapted to be rotatably mounted on the tubular seat 146. The first threaded member 142 has a first central axis 172, and the second threaded member 144 has a second central axis 174 which is substantially aligned (e.g., coaxial) with the first central axis 172 when the second threaded member 142 is mounted on the seat 146. As illustrated in FIGS. 7 and 8, the second threaded member 144 includes a threaded portion 180 and a seat portion 182. The threads of the threaded portion 180 of the second threaded member 144 and the threads of the threaded portion 148 of the first threaded member 142 have substantially circular cross sections of substantially the same diameter. However, the threaded portions 148, 180 could have different diameters, if desired. As mentioned above, for manufacturing efficiency, it is desirable for the limit nuts 130, 132 to be identical. As such, it is likewise desirable for the threads of the threaded portion 180 of the second threaded member 144 and the threads of the threaded portion 148 of the first threaded member 142 to have substantially the same diameter. A fixed stop 185 is positioned between the threaded portion 180 and the seat portion 182 of the second threaded member 144.

Figure 9:
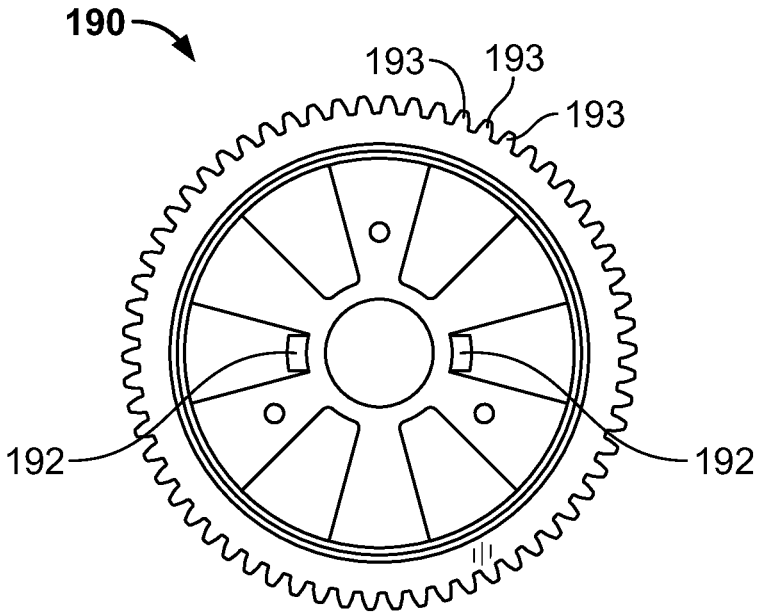
FIG. 9 is a plan view of the example thumb wheel of FIG. 2.

To selectively secure the second threaded member 144 against rotation relative to the first threaded member 142 and the end cap, the dual travel limit assembly 102 include a toothed thumb wheel 190. As shown in FIG. 9, the thumb wheel of the illustrated example is similar to a spur gear in that it includes teeth 193 on its outer perimeter.

To secure the thumb wheel 190 to the second threaded member 144, the seat portion 182 of the threaded member 144 includes flexible tabs 183 defined by slots 184. Each of the tabs 183 defines an aperture 186. As shown in FIGS. 2 and 9, the gear is provided with lugs 192. The lugs 192 of the thumb wheel 190 are dimensioned and positioned to mate with respective ones of the apertures 186 in the tabs 183. In particular, as shown in FIG. 2, the thumb wheel 190 includes an annular projection 196. The lugs are positioned on opposed sides of the annular projection 196. The annular projection 196 has an outer diameter that is slightly smaller than the inner diameter of the lumen defined by the seat portion 182 of the second threaded member 144. As a result, the annular projection 196 is dimensioned to penetrate the seat portion 182 of the second threaded member 144. When the annular projection 196 is inserted into the seat portion 182, the tabs 183 deflect outward until the lugs 192 align with respective ones of the apertures 186. Upon such alignment, the tabs 183 move from their deflected positions to the rest positions shown in FIGS. 2, 7 and 8. Engagement of the lugs 192 and the tabs 183 secures the second threaded member 144 to the thumb wheel 190. As a result, the second threaded member 144 is not rotatable relative to the thumb wheel 190, but instead the thumb wheel 190 and second threaded member 144 rotate as a single piece. Although in the illustrated example, the thumb wheel 190 and the second threaded member 144 are formed as two separate structures, the thumb wheel 190 and second threaded member 144 may alternatively be integrally formed as a unitary structure. Similarly, in the illustrated example, the second threaded member 144 is a unitary, plastic molded structure (i.e., the tubular seat 146, the threaded portion 180, the seat portion 182 and the fixed stop 185 are integrally formed). However, the second threaded member 144 may be constructed of multiple parts and/or formed of different materials, if desired.

With the second threaded member 144 seated on the seat 146 of the first threaded member and the thumb wheel 190 affixed to the second threaded member 144, the second ribs 154 of the first threaded member 142 are slid into engagement with the splined lug 160 of the end cap 110. The fastener 164 is then threaded through the first threaded member 142 and secured to the splined lug 160. As a result, the first threaded member 142 is securely fastened against rotation and translation relative to the end cap 110, while the thumb wheel 190 and the second threaded member 144 are mounted for rotation around the tubular seat 146.

To selectively secure the thumb wheel 190 and, thus, the second threaded member 144 against rotation relative to the first threaded member 142, the dual travel limit assembly 102 is further provided with a latch 200. In the illustrated example, the latch 200 is mounted to the end cap 110 and positioned to selectively lock the thumb wheel 190 (and, thus, the second threaded member 144) against rotating relative to the first threaded member 142 and the end cap 110.

Figure 5:
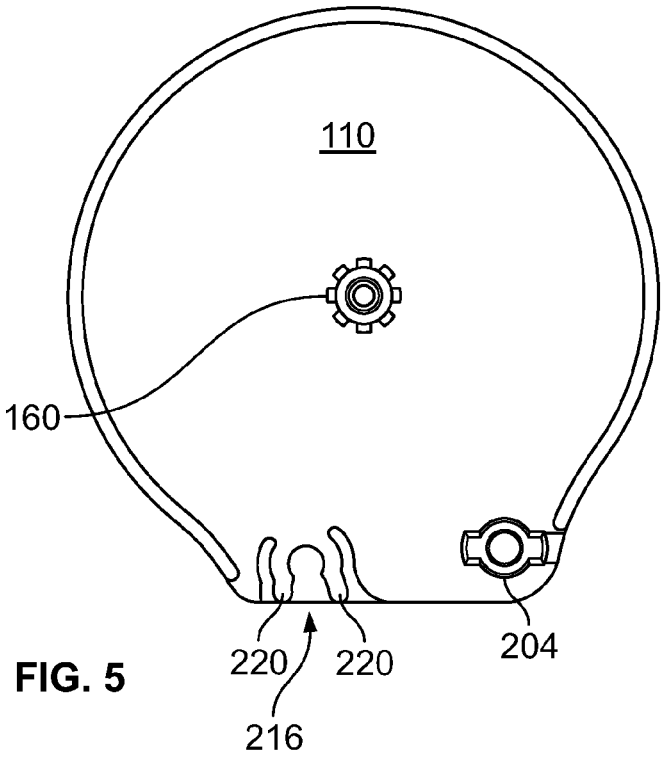
FIG. 5 is a plan view of the example end cap of FIG. 2.
Figure 6:
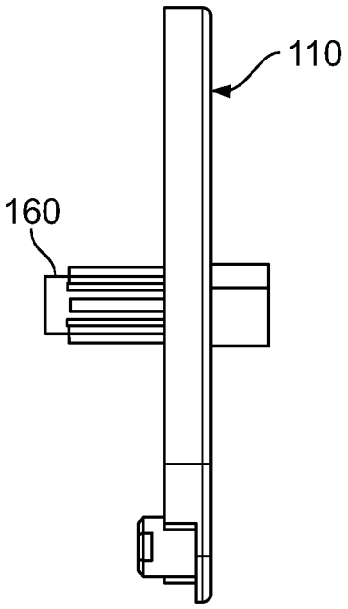
FIG. 6 is a side view of the example end cap of FIG. 5.
Figure 10:
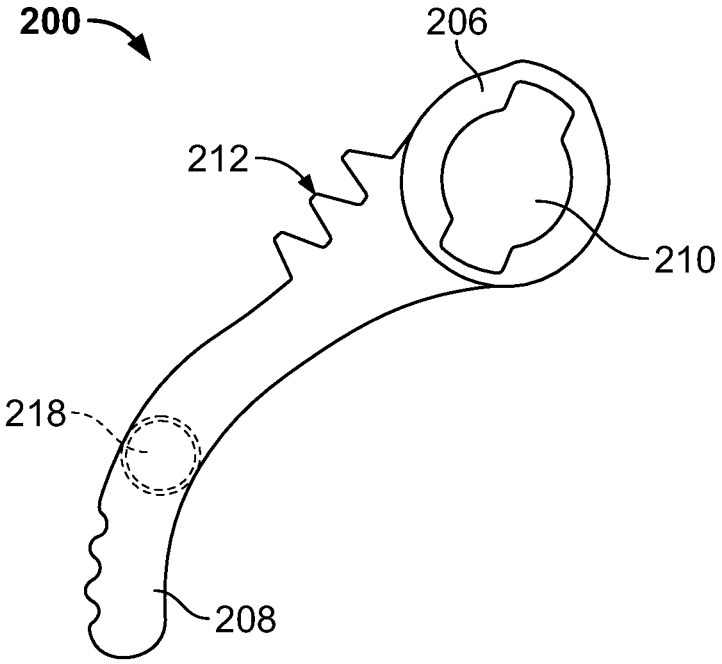
FIG. 10 is a plan view of the example lever arm of FIG. 2.

In the example of FIGS. 2 and 5, the end cap 110 includes a keyed projection 204. As shown in FIGS. 2 and 10, the latch 200 of the illustrated example includes a hub 206 and a lever arm 208. The hub 206 defines an aperture 210 that is dimensioned to mate with the keyed projection 204 in a first orientation and to prevent removal of the latch 200 in other orientations. The lever arm 208 includes a rack 212 of teeth that are dimensioned and positioned to selectively enmesh with the teeth of the thumb wheel 190. In particular, by pivoting the lever arm 208, a user can selectively lock the thumb wheel 190 against rotation relative to the end cap 110 or release the thumb wheel 190 (and, thus, the second threaded member 144) for free rotation relative to the end cap 110.

To releasably secure the lever arm with the rack 212 enmeshed with the teeth 193 of the thumb wheel 190, the example end cap 110 of FIGS. 2 and 5 includes a catch 216 and the lever arm 208 includes a lug 218. As can be seen in FIGS. 2 and 5, the catch 218 comprises a pair of opposed flexible arms 220 that define an aperture for receiving and frictionally securing the lug 218 of the lever arm 208. The flexible arms 220 are flexed outward to insert or remove the lug 218 from the catch 216. When the lug 218 is secured in the catch 216, the rack 212 enmeshes with the teeth 193 and the thumb wheel 190 is, thus, secured against rotation relative to the end cap 110.

Figure 5A:
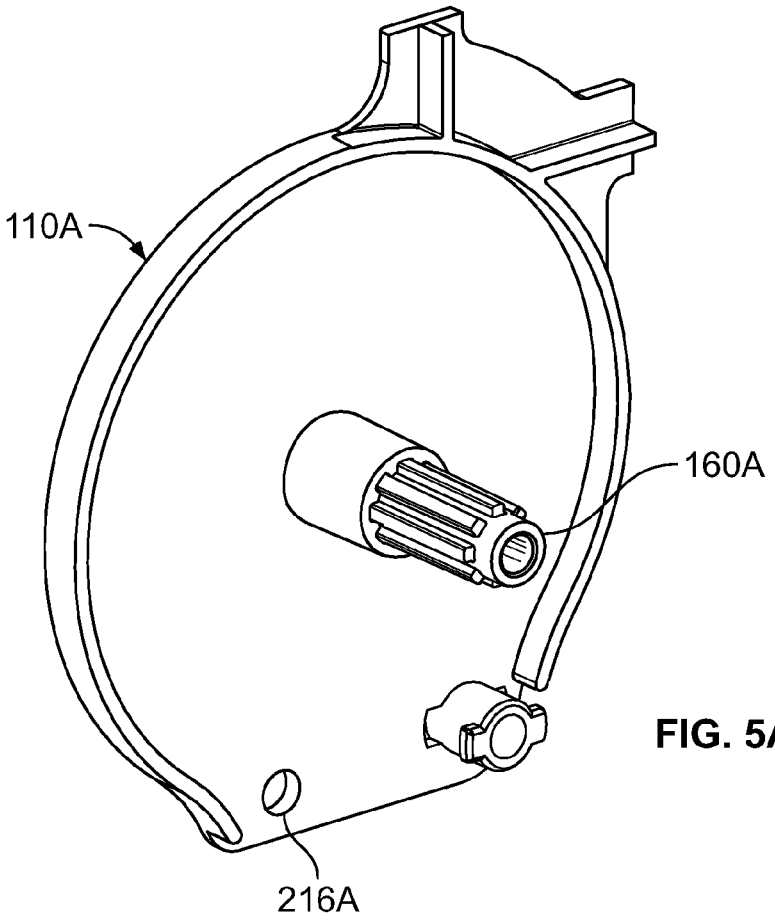
FIG. 5A is a perspective view of another example end cap that may be used in place of the end cap of FIGS. 2, 5 and 6.
Figure 11:
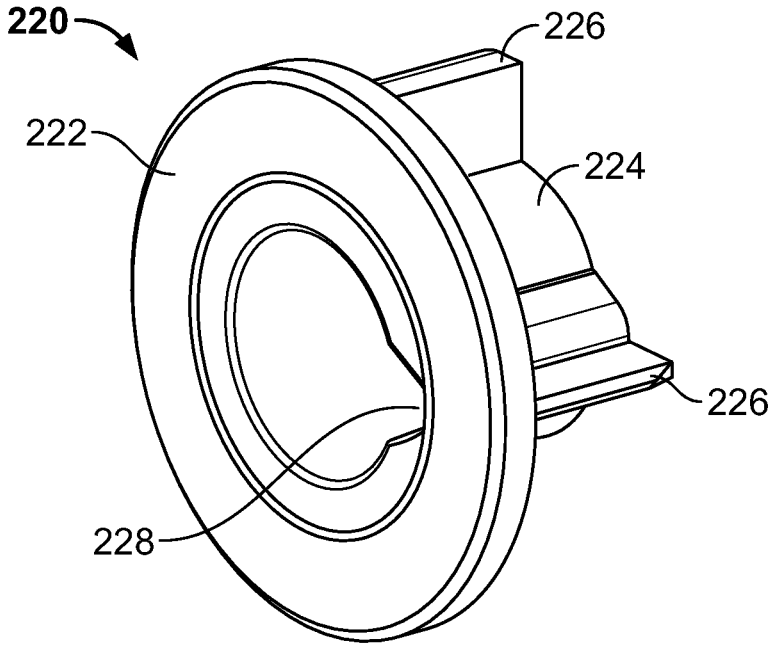
FIG. 11 is a perspective view of the example rotatable bearing of FIG. 2.
Figure 12:
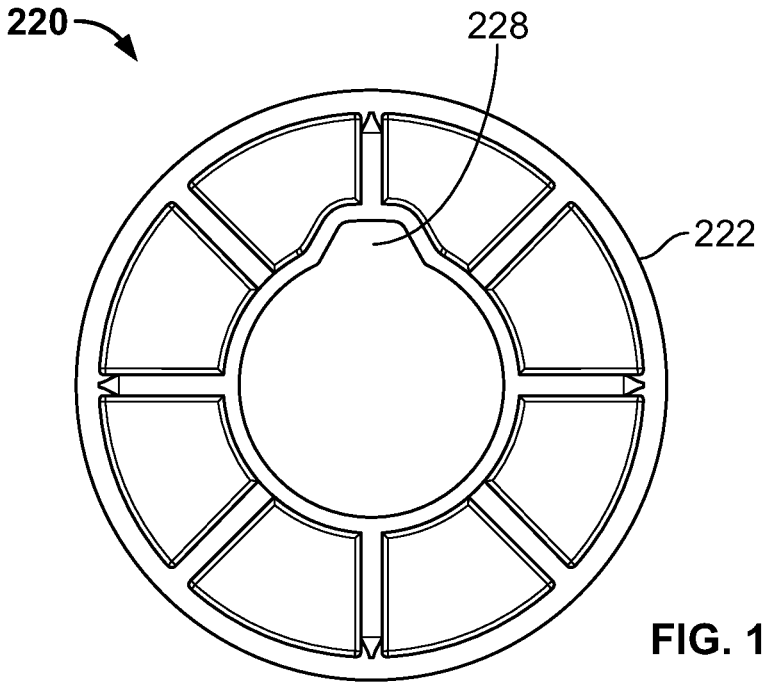
FIG. 12 is a plan view of the example rotatable bearing of FIG. 11.

In a preferred example, the end cap 110 is replaced with the example end cap 110A of FIG. 5A. The end cap 110A is substantially similar to the end cap 110. However, instead of a catch 216 with flexible arms 220, the catch 216A of the end cap 110A is implemented as a substantially circular aperture dimensioned to receive the lug 218 of the lever arm 208. In this example, the lever arm 208 is constructed of a flexible, resilient material such as plastic that enables the arm 208 to deform laterally (away from the end cap) to facilitate removal and/or insertion of the lug into the aperture/catch 216A of the end cap 110A. As shown in FIG. 5A, the splined lug 160A of the end cap 110A includes a pedestal and, thus, extends further from the plate of the end cap 110A than the spline lug 160 extends from the plate of the end cap 110. For the purpose of rotatably mounting the roller tube 104 to the end cap 110 (or 110A), the dual travel limit assembly 102 is provided with a rotatable bearing 220. As shown in FIGS. 2, 11 and 12, the rotatable bearing is an annular structure including a ring 222, an annular portion 224 and wings 226. The annular structure 224 projects from the ring 222. The lumen of the annular structure 224 is keyhole (or teardrop) shaped to facilitate sliding the bearing 220 onto the seat portion 182 of the second threaded member 144. In particular, the lumen is not circular in cross section, but instead includes an extended area 228 through which the fixed stop 185 of the second threaded member 144 passes when inserting the rotatable bearing 220 onto the second threaded member 144. The remaining dimensions of the lumen of the rotatable bearing 222 are selected to enable the bearing 222 to rotate about the seat 182 of the second threaded member.

The wings 226 of the bearing 220 extend radially outward from the outer surface of the annular structure. The lengths of the wings 226 are selected to ensure the tips of the wings engage an inner surface of the roller tube 104 when the dual travel limit assembly 102 is mounted therein. As a result, the bearing 220 rotatably supports the rotatable tube on the seat portion 182 of the second threaded member 144, thereby coupling the roller tube 104 to the end cap 110.

For the purpose of limiting rotation of the roller tube 104 to a range between a raised position and a bottom position of the covering 106, the dual travel limit assembly 102 is further provided with a first limit nut 132 and a second limit nut 130. The first and second limit nuts 130, 132 of the illustrated example are substantially identical. Therefore, only one such limit nut 130, 132 will be described in the following.

Figure 13:
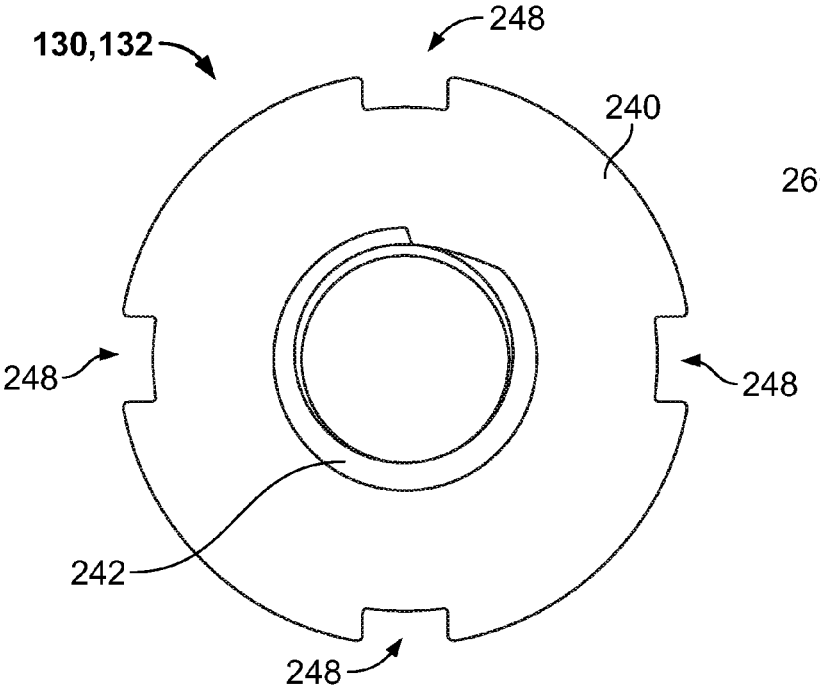
FIG. 13 is a plan view of the example limit nuts of FIG. 2; the first and second limit nuts being substantially identical.
Figure 14:
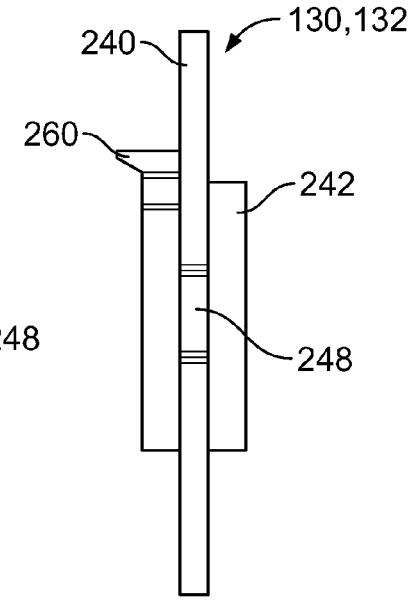
FIG. 14 is a side view of the example limit nut of FIG. 13.

As shown in FIGS. 13 and 14, the limit nut 130, 132 is an annular structure including a circular plate 240 and an inner receptacle 242. The inner receptacle 242 is threaded to thread onto the threaded portion 148, 180 of a corresponding one of the threaded members 142, 144. The outer circumference of the circular plate 240 includes slots 248. These slots 248 are dimensioned and positioned to engage a key within the roller tube 104 such that the limit nuts 130, 132 rotate with the roller tube 104. As described below, as the limit nuts 130, 132 rotate with the roller tube 104, they travel axially along the threaded portions of their respective threaded members 142, 144 and along the interior of the roller tube.

An alternative example limit nut is shown in FIGS. 14A-14D. The example limit nut of FIGS. 14A-14D is similar to the limit nuts 130, 132 described above and is intended to be used to form both the upper travel stop and the lower travel stop of the dual travel limit assembly. Therefore, the example limit nut of FIGS. 14A-14D is labeled with reference numerals 130A, 132A to indicate their interchangeability with the limit nuts 130, 132 of FIG. 2. The example limit nut 130A, 132A of FIGS. 14A-14D is an annular structure including a circular plate 240A and an inner receptacle 242A. The inner receptacle 242A is threaded to thread onto the threaded portion 148, 180 of a corresponding one of the threaded members 142, 144. The outer circumference of the circular plate 240A includes lugs forming slots 248A. These slots 248A are dimensioned and positioned to engage a key within the roller tube 104 such that the limit nuts 130A, 132A rotate with the roller tube 104. As described below, as the limit nuts 130A, 132A rotate with the roller tube 104, they travel axially along the threaded portions of their respective threaded members 142, 144 and along the interior of the roller tube.

The example limit nut of FIGS. 14A-14D has a greater number of slots 248A then the example limit nut of FIG. 13. The greater number of slots 248A improves manufacturability of the dual travel limit assembly because the limit nut 130A, 132A typically needs to be rotated a smaller distance than the limit nut 130, 132 to achieve alignment between a slot 248A and a key of the roller tube. In addition, as most easily seen in FIG. 14C, the limit nut 130A, 132A includes struts 249A to increase the strength of the limit nut 130A, 132A relative to the limit nut 130, 132.

Figure 15:
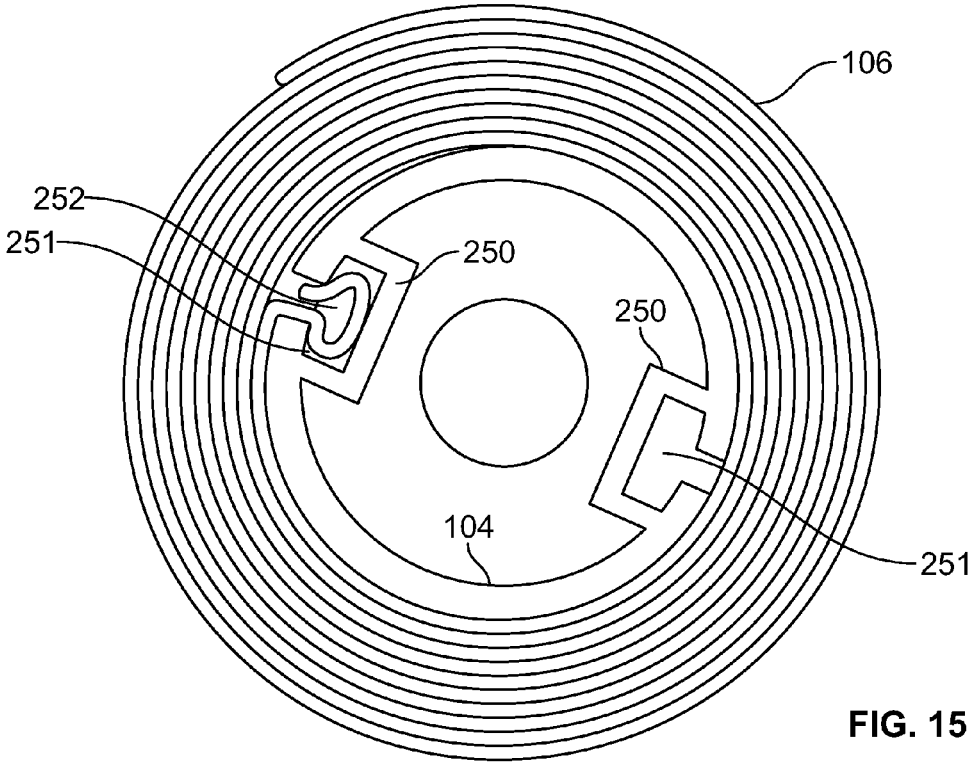
FIG. 15 is a side view of the example rotatable roller tube of FIG. 2 shown with an example covering rolled onto the same.

A cross sectional view of an example roller tube 104 is shown in FIG. 15. In the example of FIG. 15, the roller tube 104 includes internal keys 250. In the example of FIG. 15, the keys 250 serve a dual function. In addition to cooperating with the slots 248 of the limit nuts 130, 132 to drive the limit nuts as the roller tube 104 rotates, each of the keys 250 also defines a respective channel 251 to receive an upper edge of the covering 106. The channels 252 are in communication with a respective slot that extends the length of the roller tube 104 to enable the covering 106 to pass from the outside of the tube 104 into the channel 251. In the example of FIG. 15, the upper edge of the covering 106 is secured to a post by a chemical fastener such as glue and/or a mechanical fastener such as rivets, stitching, etc. The post 252 and the edge of the covering can, thus, be slid into an end of a respective one of the channels 251 defined by the keys 250 and be threaded down the tube 104 with the covering passing through the slot of the channel 251. Although two keys 250 are shown in FIG. 15, any number of keys (e.g., one, three, etc) having any type of shape(s) may be employed. In other examples, the slots are not used to receive the upper edge of the architectural opening covering. Instead, the upper edge of the covering is fastened to the exterior of the roller tube using, for example a chemical fastener (e.g., glue). Further, in some examples, the keys 250 internal to the roller tube are used solely to drive the limit nuts 130, 132, 130A, 132A. In other examples, the keys 250 engage other features (e.g., a drive feature such as a clutch, a motor adaptor, a spring, and/or an idler) to perform other functions.

Figure 14B:
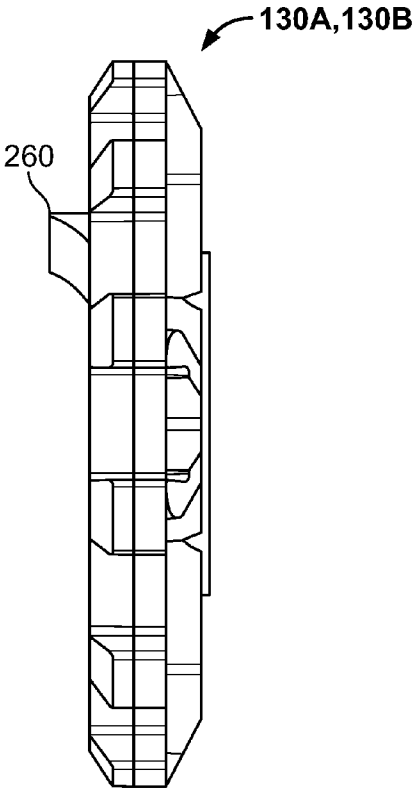
FIG. 14B is a side view of the example limit nut of FIG. 14A.
Figure 14A:
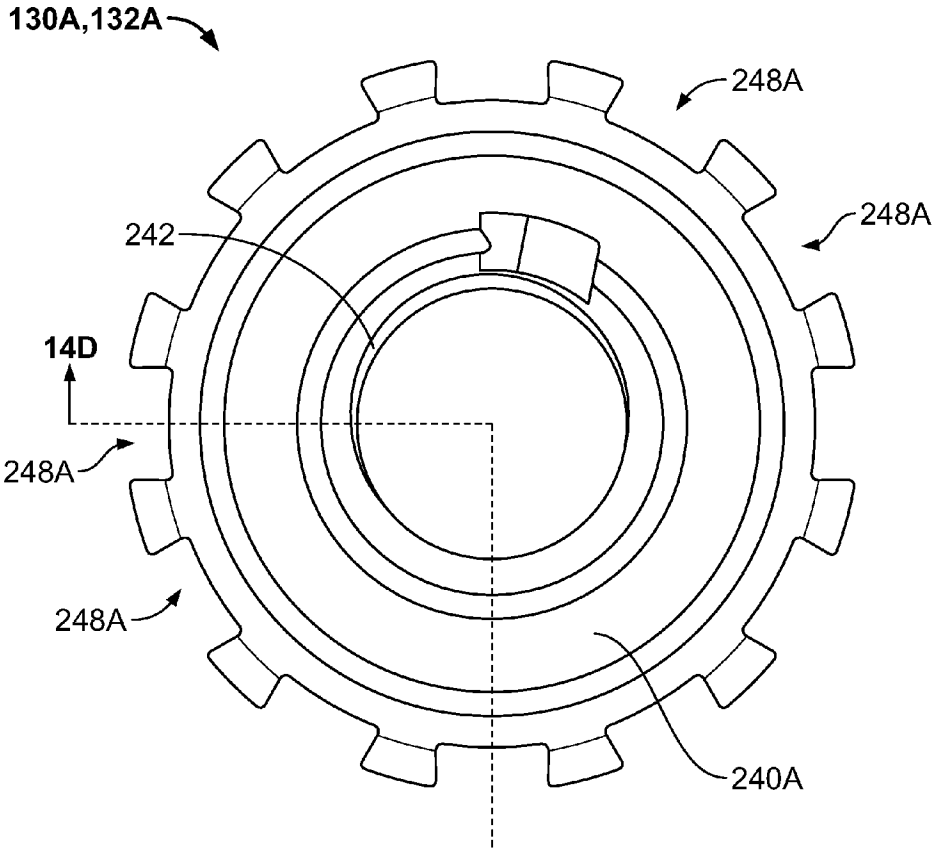
FIG. 14A is a front plan view of an alternative example limit nut which may be employed in place of the limit nut of FIGS. 2, 13, and 14.
Figure 14C:
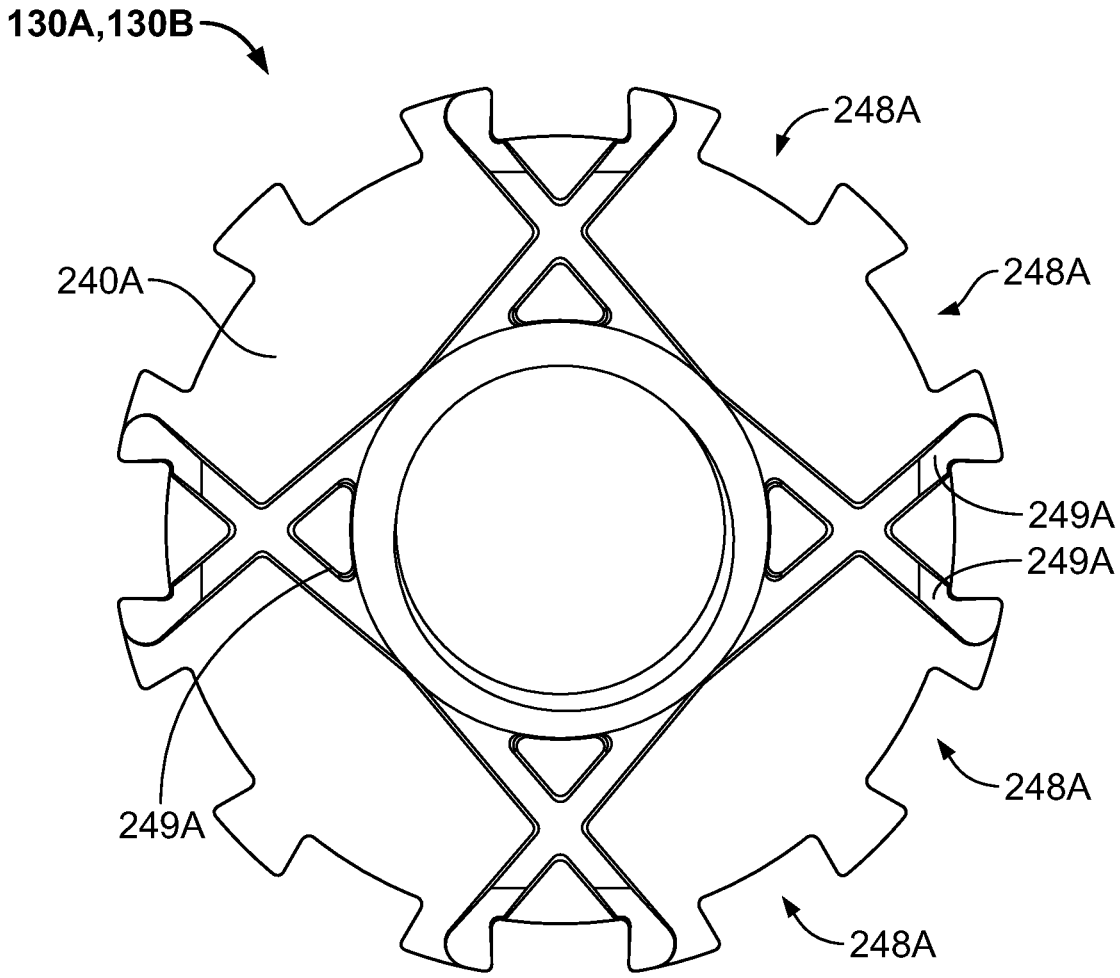
FIG. 14C is a rear plan view of the example limit nut of FIG. 14A.
Figure 14D:
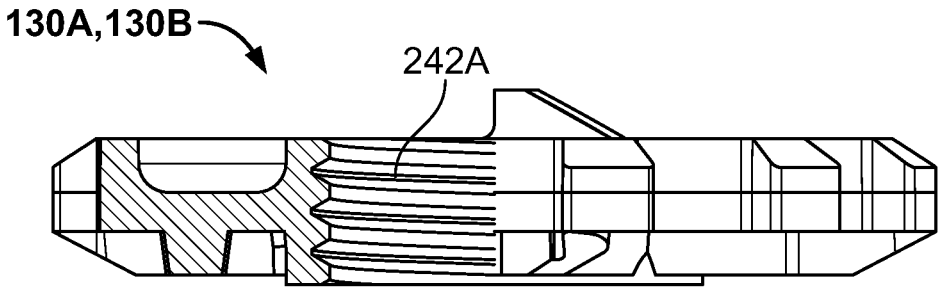
FIG. 14D is a partial cross-sectional, side view of the example limit nut of FIG. 14A.

As shown in FIG. 2, the limit nuts 130, 132 (or 130A, 132A) are rotatably mounted on respective ones of the thread members 142, 144. As shown in FIGS. 14 and 14B, each of the limit nuts 130, 132, 130*a*, 132A includes a stop 260. The stops 260 rotate with their respective limit nuts 130, 132, 130A, 132A as the roller tube 104 (through the key 250 and slot 248, 248A engagement discussed above), drives the limit nuts 130, 132, 130A, 132A along the threads 148, 180. The stop 260 of one of the limit nuts 132, 132A is positioned to engage the fixed stop 150 of the first threaded member 142 when the nut 132, 132A reaches the end of the threads 148. The stop 260 of the other limit nut 130, 130A is positioned to engage the fixed stop 185 of the second threaded member 144 when the nut 130, 130A reaches the end of the threads 180. The engagement of the rotatable stop 260 of the limit nut 130, 130A and the fixed stop 150 of the first threaded member 142 provides a limit on the raised position of the covering 106. Likewise, the engagement of the rotatable stop 260 of the limit nut 132, 132A and the fixed stop 185 of the second threaded member 144 provides a limit on the lowered position of the covering 106. In operation, the limit nuts 130, 132, 130A, 132A and the fixed stops 150, 185 of the illustrated example are positioned completely within the roller tube 104. As a result, the stops (e.g., limit nuts 130, 132 or 130A, 132A) are not visible to the end user. In some examples, there is no need for providing positive stops on the lower edge of the covering 106 to limit the raised position of the covering 106.

Figure 16:
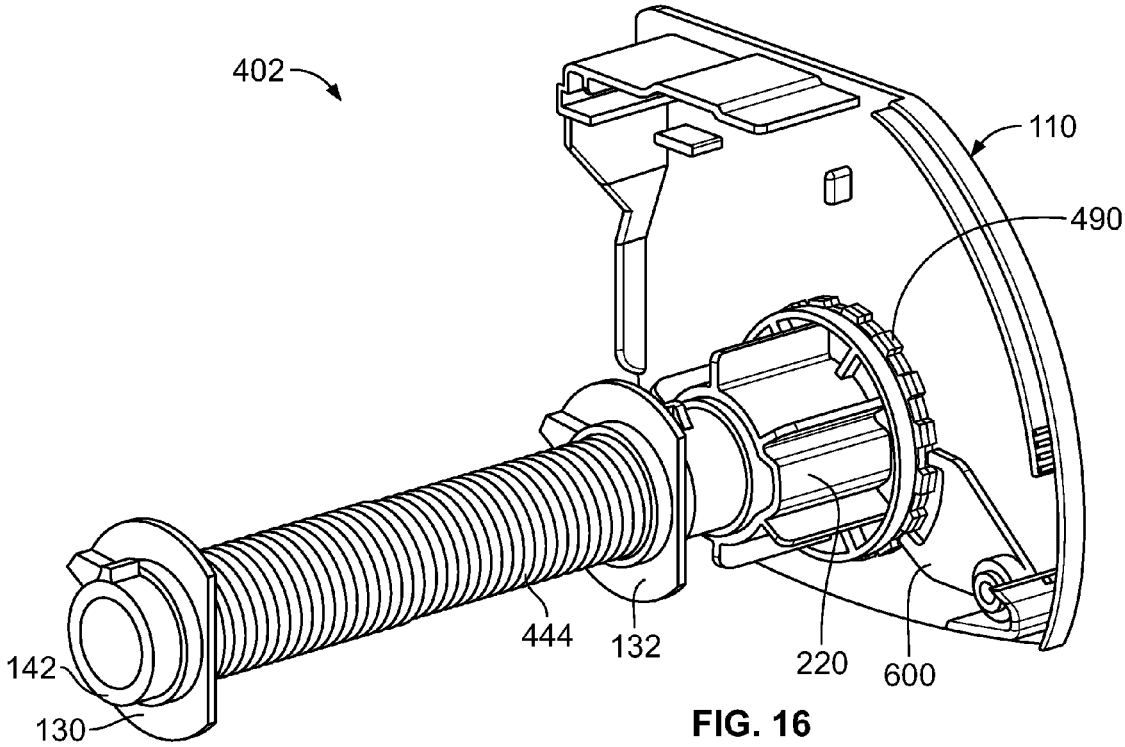
FIG. 16 is a perspective view of an alternative example dual travel limit assembly which may be employed within the rotatable roller tube of the example covering of FIG. 1.
Figure 17:
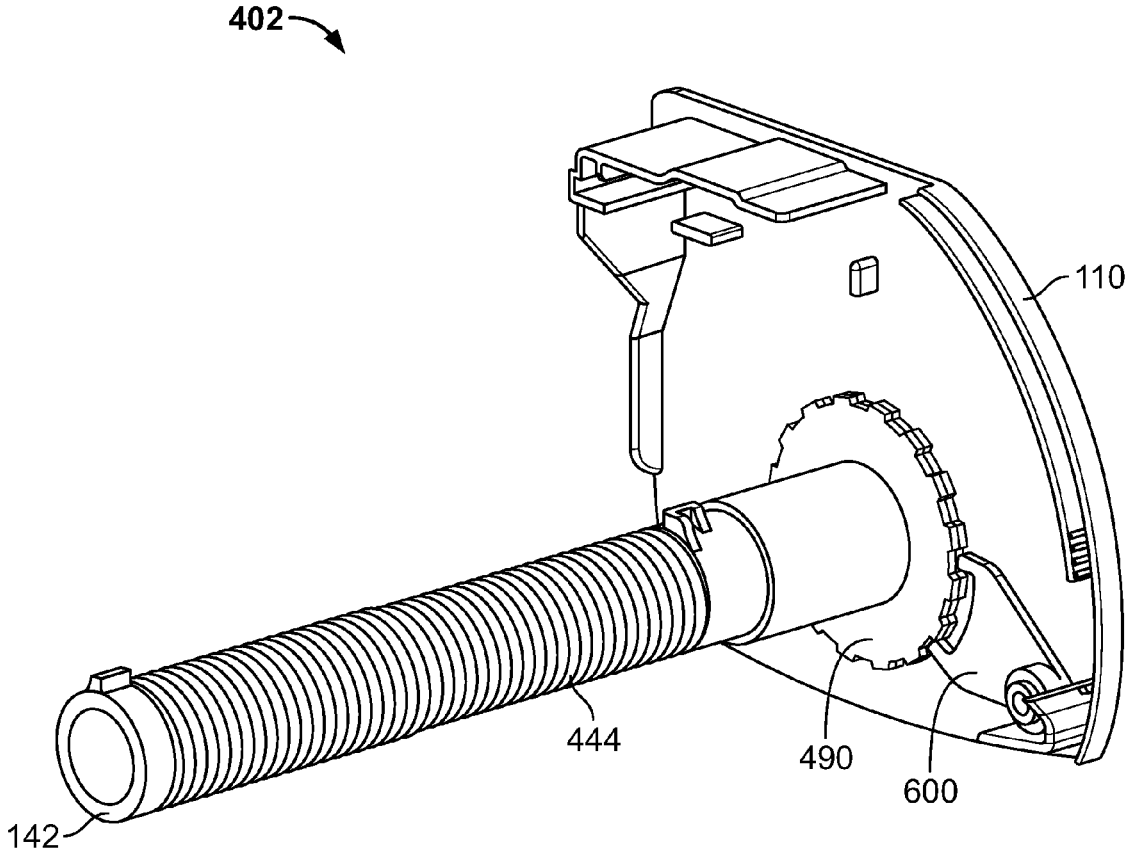
FIG. 17 is a view similar to FIG. 16 but shown with the limit nuts and bearing removed.
Figure 18:
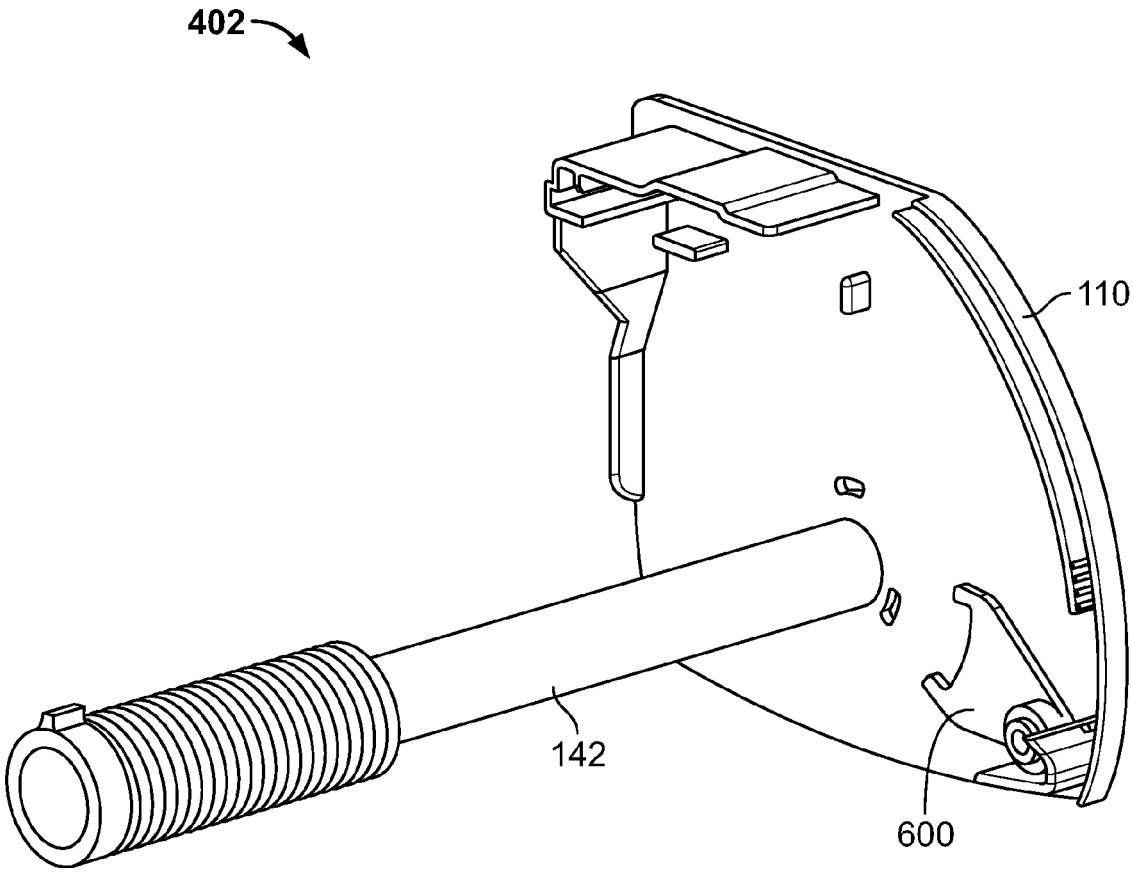
FIG. 18 is a view similar to FIG. 17 but shown with the second threaded member removed.

An alternative example dual travel limit assembly 402 is shown in FIGS. 16-18. Many of the components of the dual travel limit assembly 402 are similar or identical to the components of the example dual travel limit assembly of FIG. 2. Therefore, a description of those like components will not be repeated here. Instead, like reference numbers will be used to refer to like parts in the examples assemblies 102, 402, and only the differences will be discussed. The interested reader is referred to the above description of the example assembly 102 of FIG. 2 for a complete discussion of the like numbered parts.

The example dual travel limit assembly 402 of FIGS. 16-18, include an end cap 110, a first threaded member 142, a rotatable bearing 220, and first and second limit nuts 130, 132 or 130A, 132A. While the above parts are substantially the same as the corresponding parts of the dual travel limit assembly 102, the second threaded member 444, the thumb wheel 490 and the latch 600 of the dual travel limit assembly 402 are different from the corresponding parts of the example dual travel limit assembly 102.

In particular, the example second threaded member 444 and the example thumb wheel 490 of FIGS. 16-18 are integrally formed as one unitary structure. In addition, the diameter of the thumb wheel 490 of FIGS. 16-18 is smaller than the diameter of the thumb wheel 190 of FIG. 2. In addition to a reduced diameter, the thumb wheel 490 exhibits fewer teeth on its perimeter than the thumb wheel 190. The reduced diameter and granularity of the teeth exhibited by the thumb wheel 190 results in decreased adjustability of the dual travel limit assembly 402 relative to the dual travel limit assembly 102 discussed above. The diameter of the thumb wheel and the number of the teeth on the thumb wheel's perimeter dictates the granularity of adjustments of the lowered position supported by the dual travel limit assembly.

In addition to the above noted differences, the latch 600 of the dual travel limit assembly 402 differs from the latch 200 described above. In particular, the example latch 600 comprises a fork with two tines that engage the teeth of the thumb wheel 490. The latch 600 forms a crushed rib fit (e.g., a friction fit) with a lug extending from the end cap 110. The lug of the end cap 110 that receives the fork 600 differs from the lug 204 in that it is not keyed, but instead is generally cylindrical. The latch 200 is advantageous over the latch 600 in that the latch 200 is easier to release after and/or during installation to facilitate adjustment of the covering assembly. The latch 600 is advantageous in that it is less exposed to the end user and, thus, less susceptible to adjustment by the consumer.

Figure 19:
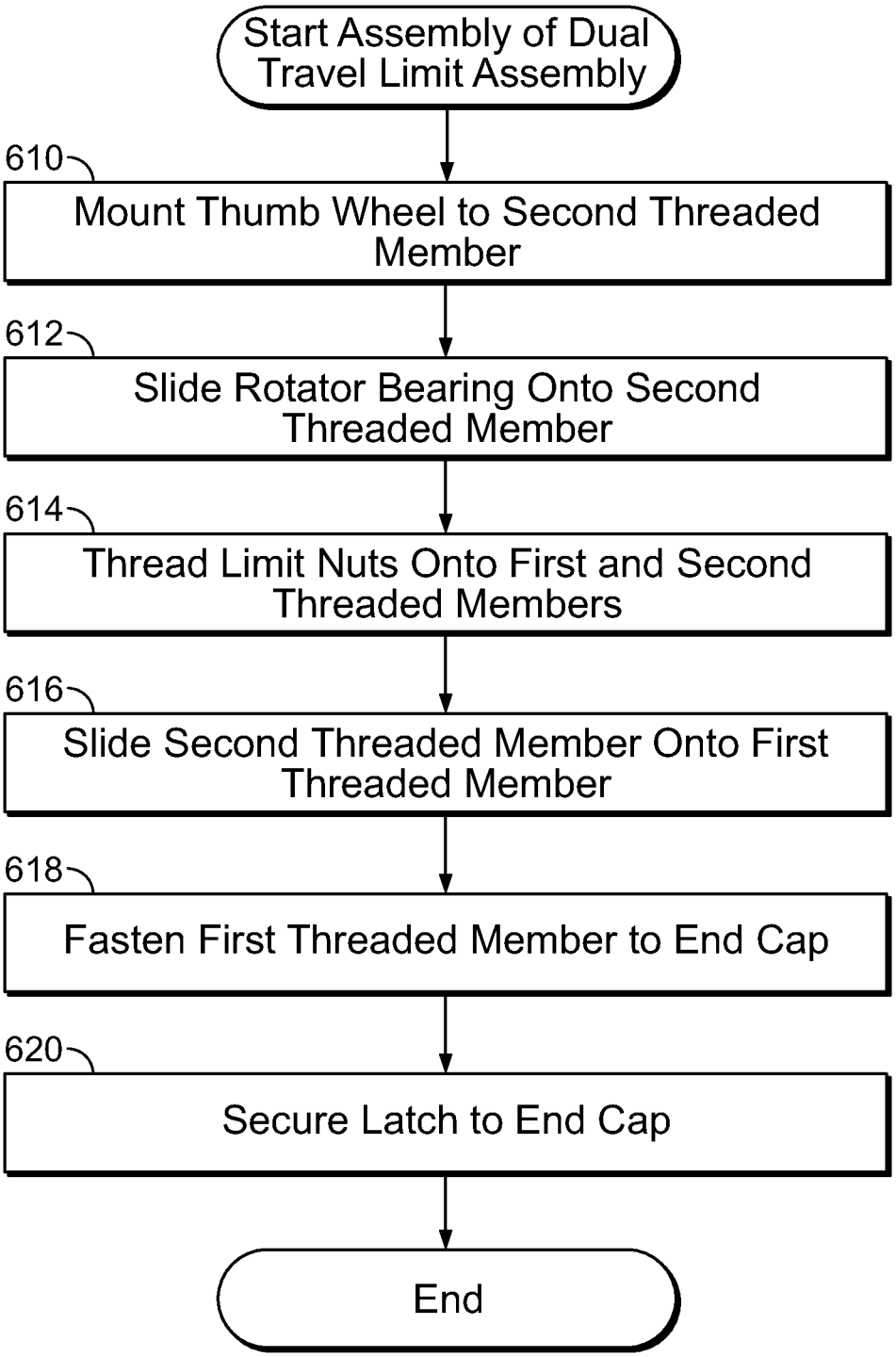
FIG. 19 is a flowchart illustrating an example method of assembling the example dual travel limit assembly of FIG. 2.

A method of assembling the example dual travel limit assembly 102 is illustrated by the flowchart of FIG. 19. While the example method will be explained with reference to FIG. 19, many other methods of assembling the dual travel limit mechanism 102 described above may alternatively be used. For example, the order of execution of the blocks may be changed, and/or some of the blocks described may be changed, eliminated, and/or combined. Similarly, although the following refers to the assembly of dual travel limit mechanism 102, the method of FIG. 19 applies to the dual travel limit assembly 402 with slight modifications.

The method of FIG. 19 begins with mounting the thumb wheel 190 to the second threaded member 144 (block 610). As discussed above, the annular projection 196 of the thumb wheel 190 penetrates the seat portion 182 of the second threaded member 144. The lugs 192 of the thumb wheel 190 cooperate with apertures 183 to secure the thumb wheel 190 to the second threaded member 144.

The rotatable bearing 220 is then slid onto the second threaded member 144 (block 614). As mentioned above, the lumen of the bearing is teardrop shaped to permit sliding of the bearing 220 over the fixed stop 185 of the second threaded member 144. In the illustrated example, the bearing 220 is slid onto the seat 182 of the second threaded member 144 such that the ring 222 of the bearing 220 is adjacent a front face of the thumb wheel 190.

The limit nuts 130, 132 or 130A, 132A are then threaded onto their respective threaded member 142, 144 (block 614). As mentioned above, threading the limit nut 130 or 130A onto the second threaded member 144 positions the limit nut 130 or 130A to cooperate with the fixed stop 185 to define a bottom travel limit for the covering 106. Similarly, threading the limit nut 132 or 132A onto the first threaded member 142 positions the limit nut 132 or 132A to cooperate with the fixed stop 150 to define a top travel limit for the covering 106.

The second threaded member 144 is then penetrated by the first threaded member 142 (i.e., the second threaded member 144 is slid onto the tubular seat 146 of the first threaded member 142) to form the spindle 140 (block 616). The first threaded member 142 is then slid onto the splined lug 160 and the fastener 164 is threaded through the spindle 140 to fasten the first threaded member to the end cap 110 or 110A (block 618). The latch 200 is then installed by mounting it to the end cap (block 620).

A method of assembling a covering assembly 100 will now be explained in connection with FIG. 20. While the example method will be explained with reference to FIG. 20, many other methods of assembling the covering assembly 100 described above may alternatively be used. For example, the order of execution of the blocks may be changed, and/or some of the blocks described may be changed, eliminated, and/or combined. Similarly, although the following refers to the assembly of a covering assembly 100 incorporating the dual travel limit mechanism 102 of FIG. 2, the method of FIG. 20 applies to the dual travel limit assembly 402 with slight modifications.

Figure 20:
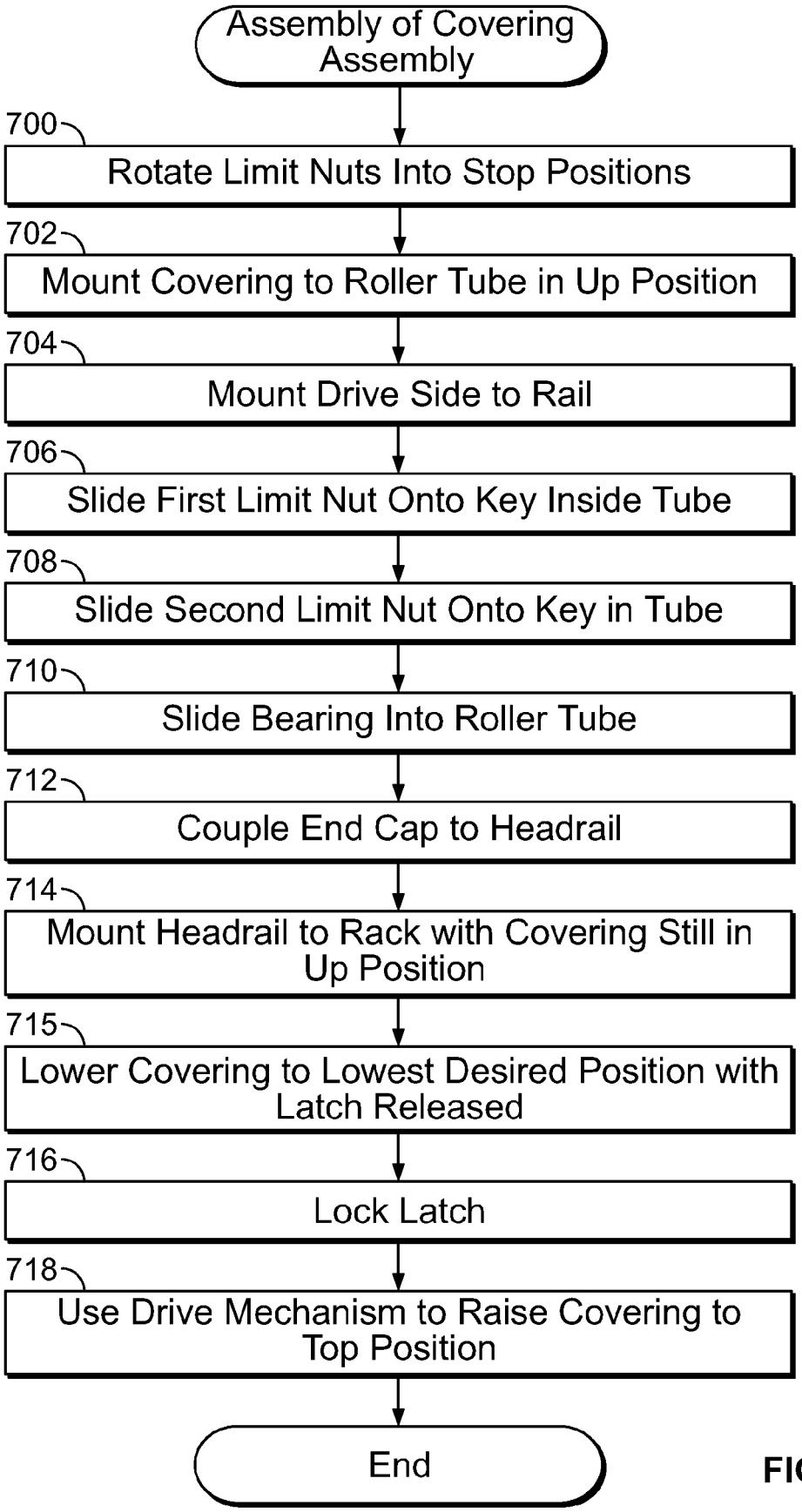
FIG. 20 is a flowchart illustrating an example method of assembling the example architectural opening covering of FIGS. 1 and 2.

The example method of FIG. 20 begins by rotating the limit nuts 130, 132 or 130A, 132A of a dual travel limit assembly 102 into engagement with their respective fixed stops 152, 185 (block 700). Thereafter, the covering 106 is mounted to a rotatable roller tube 104 and rolled up into the raised position (block 702). As explained in connection with FIG. 15, the covering 106 may be mounted to the roller tube 104 by feeding it into a channel defined by a key 250 internal to the roller tube 104 or by fastening it to the exterior of the roller tube.

With the covering positioned on the tube 104, a drive mechanism and end cap is mounted to the roller tube 104 (block 704). The side of the roller tube that receives the drive mechanism is dependent upon end user preferences (e.g., left side controls versus right side controls). Any desired drive mechanism and/or controls may be employed.

Turning to the side of the roller tube 104 opposite the drive mechanism, the limit nut 130 or 130A of the dual limit travel assembly 102 is slid into engagement with a key 250 within the roller tube 104 (block 706). The dual limit travel assembly 102 is advanced further into the roller tube 104 such that the limit nut 132 or 132A of the dual limit travel assembly 102 is also slid into engagement with the key 250 (preferably the same key 250, but possibly a second key) within the roller tube 104 (block 708). The dual limit travel assembly 102 is advanced still further into the roller tube 104 until the bearing 220 is slid into the roller tube 104 (block 710). Thereafter, the end cap 110 or 110A is secured to a headrail 108 by, for example, a friction fit and/or with chemical or mechanical fasteners (block 712). The covering assembly 100 is then complete.

To adjust the covering assembly 100, it is mounted to an adjustment rack (block 714). An adjustment rack is a structure to temporarily hold the covering assembly 100 as if it were mounted adjacent an architectural opening. The covering assembly 100 is mounted to the rack with the covering 106 still in its uppermost position.

The covering 106 is then rolled down to its lowermost position while the latch 200 is in the released position (block 715). In the illustrated example, the latch 200 is released by applying sufficient force to the lever 208 to displace the lug 218 from the catch 216 or 216A. As explained above, releasing the latch 200 permits rotation of the thumb wheel 190 and the second threaded member 144. Because the second threaded member 144 carries the limit nut 130 or 130A and because the bearing 220 is free to rotate about the second threaded member 144, releasing the second threaded member 144 for rotation in this manner enables adjustment of the roller tube 104 (and, thus, the covering 106) relative to the limit nut 130 or 130A. As a result, the covering 106 can be lowered without changing the position of the limit nut 130 or 130A relative to the fixed stop 185. When the desired lowermost position is achieved (block 715), the latch is locked to thereby secure the second threaded member 144 relative to the end cap 110 or 110A.

Since the limit nut 130 or 130A is engaged with the fixed stop 185 when the latch 200 is secured (block 718), and since the limit nut 132 is no longer free to rotate due to the engagement of the latch 200 with the thumb wheel 190, the limit nut 130 or 130A and the fixed stop 185 cooperate to define a lower travel limit (i.e., the lowermost position) for the covering 106. As a result, the dual travel limit assembly 102 is now configured to provide travel limits on both the fully raised and fully lowered positions of the covering 106. In particular, the limit nuts 130, 132 or 130A, 132A are driven axially along the threaded portions of the first and second threaded members 142, 144 as the roller tube is rotated by the drive mechanism. When the limit nut 132 or 132A engages the stop 152, the roller tube 104 is prevented from rotating further in the corresponding direction, thereby defining the fully raised position of the covering 106. Similarly, when the limit nut 130 or 130A engages the stop 185, the roller tube 104 is prevented from rotating further in the corresponding direction, thereby defining the fully lowered position of the covering 106.

After the lever arm is latched (block 716), the drive mechanism is then used to roll the covering up on the roller tube 104 into a desired raised position (block 718). The limit nut 130 or 130A moves away from the fixed stop 185 throughout this raising process without interfering with the upward movement of the covering 106.

Although the above examples provide dual travel limit assemblies in which the lowermost position of the window covering can be easily adjusted, for example, in the field, the above described can be adapted to instead facilitate easy adjustment of the upper travel limit by reversing the threads of the threaded members 142, 144. Such an approach is advantageous in window coverings where it is desirable to reduce or eliminate uncaptured loops in an architectural opening covering. In such an approach, the limit nut 130 or 130A functions as the top stop and the limit nut 132 or 132A functions as the bottom stop.

Figure 21:
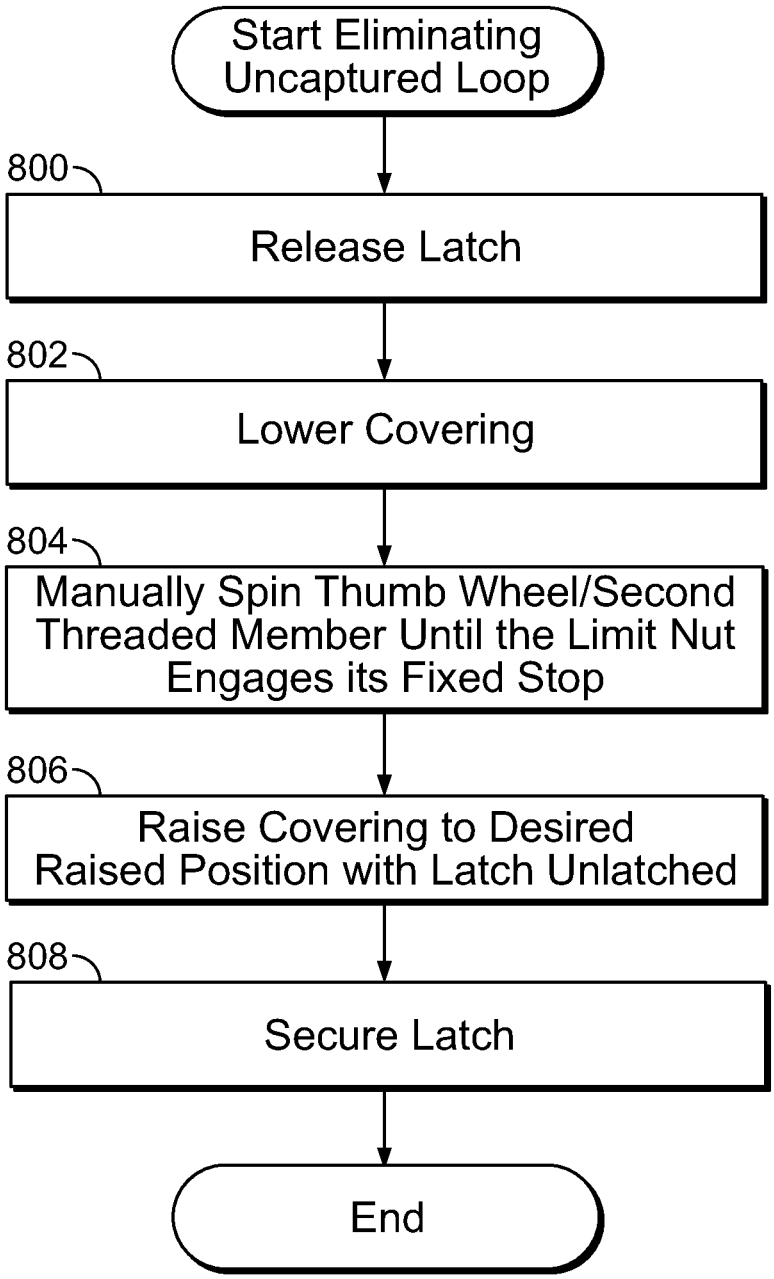
FIG. 21 is a flowchart illustrating an example method of eliminating an uncaptured loop in the example architectural opening covering of FIGS. 1 and 2.

An example method of eliminating an uncaptured loop in an architectural opening covering 100 is illustrated by the flowchart of FIG. 21. While the example method will be explained with reference to FIG. 21, many other methods of adjusting the covering assembly 100 described above may alternatively be used. For example, the order of execution of the blocks may be changed, and/or some of the blocks described may be changed, eliminated, and/or combined. Similarly, although the following refers to the assembly of dual travel limit mechanism 102, the method of FIG. 21 applies to the dual travel limit assembly 402 with slight modifications.

The method of FIG. 21 may be performed at any time after installation at the end user site and/or at the manufacturing facility prior to delivery and/or sale of the covering 100. Thus, the following method may be performed with the covering 100 mounted adjacent an architectural opening (e.g., in a consumer's household) and/or with the covering 100 temporarily mounted to a rack in the manufacturing facility.

The example method of FIG. 21 begins with the covering 106 in the uppermost raised position. The latch 200 is released (e.g., by forcing the lug 218 out of the catch 216 or 216A) (block 800). Releasing the latch 200 permits adjustment of a rotatable top stop (e.g., limit nut 130 or 130A) within the rotatable roller tube 104. The covering 106 is then lowered a small amount (e.g., six inches) to a position intermediate the raised position and the lowered position (block 802). Subsequently, the top stop (e.g., limit nut 130 or 130A) is manually rotated (e.g., by spinning the thumb wheel 190) until it engages the fixed stop 185 within the roller tube 104 (block 804). The drive mechanism is then used to raise the covering 106 to the desired raised position wherein the covering 106 does not exhibit an uncaptured loop (block 806). The latch 200 is then secured to define the topmost raised position, thereby ensuring no uncaptured loop exists when the covering 106 is in the raised position (block 808).

Although in some of the above examples, the leading edge of the covering 106 is fixed within a channel internal to the roller tube 104, other approaches to fastening the covering to the tube 104 are likewise appropriate. For example, in some applications (e.g., those using a motor to drive rotation of the roller tube 104), the edge of the covering may be secured to an external surface of a roller tube using, for instance, a chemical fastener such as glue. The location at which the covering 106 is secured to the tube 104 may be referred to as a seam. In such examples, it may be desirable to reduce the stress on the chemical fastener caused by the weight of the covering 106 when the covering is in the fully lowered position. To accomplish this task, the limit nut 130 or 130A may be adjusted to define the fully lowered position such that the seam is captured beneath a portion of the covering 106. In other words, the dual limit travel assembly may be adjusted to define the fully lowered position such that the covering is wrapped one or more times around the tube when the covering is in the fully lowered position. In this way, the chemical fastener is captured under one or more layers of the covering 106 even when the covering is fully lowered, thereby reducing the stress on the chemical fastener caused by the weight of the lowered covering.

From the foregoing, it will be appreciated that the above disclosed examples provide architectural opening covering assemblies that incorporate dual travel limit mechanisms. In some examples, the bottom travel limit is adapted for easy field adjustment to ensure the covering extends over the full length of the architectural opening. In other examples, the top travel limit is adapted for easy adjustment to enable, for example, causing a covering to stop at a desired height below a headrail (e.g., to match the stop height of an adjacent covering) and/or to prevent or reduce the appearance of uncaptured loops. The disclosed example dual travel limit mechanisms define both an uppermost raised position and a lowermost lowered position of the covering by stops located within the roller tube, thereby eliminating a need for visible stops on the lower edge or any other exposed location of the covering.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An architectural opening covering assembly comprising:

a rotatable roller tube;

a covering mounted to the roller tube, the covering being movable between a first position and a second position, the covering being wound on the roller tube in the second position;

a first threaded member and a second threaded member, the first threaded member comprising a tubular seat and the second threaded member comprising a cavity to at least partially receive the tubular seat and enable the second threaded member to be selectively rotatable relative to the first threaded member;

a first limit nut located internal to and coaxially aligned with the roller tube to define the first position; and a second limit nut located internal to and coaxially aligned with the roller tube to define the second position.

2. The architectural opening covering assembly of claim 1, wherein the first position is a fully lowered position and the second position is a fully raised position.

3. The architectural opening covering assembly of claim 1, wherein the first limit nut is threaded on the second threaded member.

4. An architectural opening covering assembly comprising:

a rotatable roller tube;

a covering mounted to the roller tube, the covering being movable between a first position and a second position, the covering being wound on the roller tube in the second position;

a first threaded member and a second threaded member, the second threaded member being selectively rotatable relative to the first threaded member;

a first limit nut located internal to the roller tube to define the first position;

a second limit nut located internal to the roller tube to define the second position, wherein the first limit nut is threaded on the second threaded member;

a thumb wheel associated with the second threaded member; and a latch to selectively lock the second threaded member against rotating relative to the first threaded member.

5. An architectural opening covering assembly:

a rotatable roller tube;

a covering mounted to the roller tube, the covering being movable between a first position and a second position, the covering being wound on the roller tube in the second position;

a first threaded member and a second threaded member, the second threaded member defining an aperture to receive the first threaded member and enable the second threaded member to be selectively rotatable relative to the first threaded member;

a first limit nut located internal to the roller tube to define the first position; and a second limit nut located internal to the roller tube to define the second position, wherein the first limit nut is threaded on the second threaded member, the first threaded member having a first central axis, and the second threaded member having a second central axis substantially aligned with the first central axis.

6. An architectural opening covering assembly comprising:

a rotatable roller tube;

a covering mounted to the roller tube, the covering being movable between a first position and a second position, the covering being wound on the roller tube in the second position;

a first threaded member and a second threaded member, the second threaded member being selectively rotatable relative to the first threaded member;

a first limit nut located internal to the roller tube to define the first position; and a second limit nut located internal to the roller tube to define the second position, the first limit nut threaded on the second threaded member, the first threaded member having a first central axis, and the second threaded member having a second central axis substantially aligned with the first central axis, wherein the first threaded member includes a tubular seat and the second threaded member is rotatably mounted on the tubular seat.

7. An architectural opening covering assembly comprising:

a rotatable roller tube;

a covering mounted to the roller tube, the covering being movable between a lowered position and a raised position, the covering being wound on the roller tube in the raised position;

a drive mechanism to move the covering between the raised and lowered positions;

a dual travel limit assembly comprising:

a first threaded member;

a second threaded member comprising an aperture to at least partially receive the first threaded member and enable the second threaded member to be selectively rotatable relative to the first threaded member;

a first limit nut threadably engaging the first threaded member and cooperating with a first fixed stop to define the raised position; and a second limit nut threadably engaging the second threaded member and cooperating with a second fixed stop to define the lowered position, the first limit nut coaxially aligned with the second limit nut.

8. An architectural opening covering assembly comprising:

a rotatable roller tube;

a covering mounted to the roller tube, the covering being movable between a lowered position and a raised position, the covering being wound on the roller tube in the raised position;

a drive mechanism to move the covering between the raised and lowered positions;

a dual travel limit assembly comprising:

a first threaded member;

a second threaded member, the second threaded member selectively rotatable relative to the first threaded member;

a first limit nut threadably engaging the first threaded member and cooperating with a first fixed stop to define the raised position; and a second limit nut threadably engaging the second threaded member and cooperating with a second fixed stop to define the lowered position;

a thumb wheel associated with the second threaded member; and a latch to selectively lock the second threaded member against rotating relative to the first threaded member.

9. The architectural opening covering assembly of claim 7 wherein the first threaded member has a first central axis, and the second threaded member has a second central axis substantially aligned with the first central axis.

10. An architectural opening covering assembly comprising:

a rotatable roller tube;

a covering mounted to the roller tube, the covering being movable between a lowered position and a raised position, the covering being wound on the roller tube in the raised position;

a drive mechanism to move the covering between the raised and lowered positions;

a dual travel limit assembly comprising:

a first threaded member;

a second threaded member, the first threaded member having a first central axis, and the second threaded member having a second central axis substantially aligned with the first central axis, wherein the first threaded member includes a tubular seat and the second threaded member is rotatably mounted on the tubular seat;

a first limit nut threadably engaging the first threaded member and cooperating with a first fixed stop to define the raised position; and a second limit nut threadably engaging the second threaded member and cooperating with a second fixed stop to define the lowered position.

11. The architectural opening covering assembly of claim 7 wherein the first and second limit nuts are located within the roller tube.

12. The architectural opening covering assembly of claim 7 wherein the covering is secured to an external surface of the roller tube at a seam and the first limit nut defines the lowered position such that the seam is captured beneath a portion of the covering.

13. A method of assembling a dual travel limit mechanism for an architectural opening covering assembly comprising:

sliding a bearing onto a second threaded member;

threading a first limit nut onto a first threaded member and a second limit nut onto the second threaded member, the first threaded member being at least partially received within an aperture of the second threaded member to enable the second threaded member to rotate rotatable relative to the first threaded member, the first limit nut coaxially aligned with the second limit nut, the first limit nut being positioned to cooperate with a first fixed stop to define a top travel limit for the covering, the second limit nut being positioned to cooperate with a second fixed stop to define a bottom travel limit for the covering; and fastening the first threaded member to an end cap.

14. A method of assembling a dual travel limit mechanism for an architectural opening covering assembly comprising:

sliding a bearing onto a second threaded member;

threading a first limit nut onto a first threaded member and a second limit nut onto the second threaded member, the first limit nut being positioned to cooperate with a first fixed stop to define a top travel limit for the covering, the second limit nut being positioned to cooperate with a second fixed stop to define a bottom travel limit for the covering;

fastening the first threaded member to an end cap; and penetrating the second threaded member with the first threaded member prior to fastening the first threaded member to the end cap.

15. The method of claim 14 wherein the threads of the second threaded member and the threads of the first threaded member have substantially circular cross sections of substantially the same diameter.

16. The method of claim 15 wherein a central axis of the second threaded member is substantially co-axial with a central axis of the first threaded member.

17. The method of claim 16 wherein the second threaded member is tubular and the first threaded member is tubular.

18. The method of claim 14 wherein the threads of the second threaded member and the threads of the first threaded member have substantially circular cross sections of different diameters.

19. A method of assembling an architectural opening covering assembly comprising:

mounting a covering to a rotatable roller tube;

sliding a bearing onto a second threaded member;

threading a first limit nut onto the second threaded member and a second limit nut onto a first threaded member;

fastening the first threaded member to an end cap;

rotating the first and second limit nuts into respective engagement with first and second fixed stops;

sliding the first and second limit nuts into engagement with a key within the roller tube;

coupling the end cap to a headrail;

releasing a latch to permit rotation of the second threaded member carrying the first limit nut;

raising the covering to a raised position; and securing the latch to define a top travel limit for the covering.

20. The method of claim 19 further comprising reducing an uncaptured loop in the covering.

21. The method of claim 20 wherein reducing the uncaptured loop comprises:

releasing the latch to permit adjustment of the second threaded member;

lowering the covering;

moving the first limit nut until it engages the first fixed stop;

raising the covering to a position wherein the covering lacks an uncaptured loop; and thereafter securing the latch.

22. The method of claim 21 wherein moving the first limit nut comprises rotating a thumb wheel.

* * * * *